US006532356B2

(12) United States Patent
Taguchi

(10) Patent No.: US 6,532,356 B2
(45) Date of Patent: Mar. 11, 2003

(54) GUIDE MECHANISM, PAPER FEED CONTROL METHOD, AND IMAGE-FORMING DEVICE

(75) Inventor: Yoshiyuki Taguchi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/771,965

(22) Filed: Jan. 30, 2001

(65) Prior Publication Data

US 2002/0025205 A1 Feb. 28, 2002

(30) Foreign Application Priority Data

Aug. 25, 2000 (JP) ..... 2000-256347

(51) Int. Cl.[7] ..... G03G 15/00; B41L 1/30
(52) U.S. Cl. ..... 399/384; 270/40
(58) Field of Search ..... 270/40, 41; 271/3.08, 271/186; 399/384, 385, 386, 387

(56) References Cited

U.S. PATENT DOCUMENTS 4,504,051 A * 3/1985 Bittner et al. ..... 270/40

FOREIGN PATENT DOCUMENTS

JP 3015114 6/1995
JP 98-6683 10/1998

* cited by examiner

*Primary Examiner*—Hoang Ngo
(74) *Attorney, Agent, or Firm*—Armstrong, Westerman & Hattori, LLP

(57) ABSTRACT

An exemplified object of the present invention is to provide a guide mechanism, paper feed control method, and image-forming device that can prevent a jam or image degradation from occurring. The guide mechanism of the present invention includes a guide part that guides continuous paper from a paper feeder part storing the continuous paper to a conveyor part while regulating a conveyance route of the continuous paper, and a driving part that drives the guide part and the paper feeder part to move relatively and automatically according to a storage amount of the continuous paper in the paper feeder part.

9 Claims, 9 Drawing Sheets

GUIDE MECHANISM, PAPER FEED CONTROL METHOD, AND IMAGE-FORMING DEVICE

BACKGROUND OF THE INVENTION

The present invention relates generally to image-forming devices, and particularly to a paper feed mechanism of an image-forming device that employs continuous paper. The present invention is suitable, for example, for an output device for use with a computer system that needs to print large amounts of data.

Hereupon, the phrase, "continuous paper", is intended to denote continuous-form paper in a folded stack, roll or other shapes, and an OHP film, or other types of recordable media that permit a user's discretionary setting of a recording length. The width of the continuous paper has a standardized or predetermined dimension.

The electrophotographic image-forming device that uses continuous paper as a recordable medium (continuous paper printer) is utilized for printing (outputting) large amounts of data. In recent years, high-speed continuous paper printers that can create a printed output for a short time by printing out processed information received from networked small processors or main frames have become commercially practical. The continuous printer generally comprises a printing part, a paper feeder part, a conveyor part, and a collecting part.

The printing part, which adopts the electrophotographic method employing a photoconductive insulator (e.g., photosensitive drum, and photosensitive belt), follows the procedural steps of charging, latent image formation, development, transfer, and fixing. The charging step uniformly electrifies the photosensitive drum (e.g., at −700 V). The latent image formation step irradiates a laser beam or the like on the photosensitive drum based upon print data, and changes the electrical potential at the irradiated area down, for example, to −50 V or so, forming an electrostatic latent image. The development step electrically deposits a developer onto the photosensitive drum using, for example, the reversal process, and visualizes the continuous electrostatic latent image. The transfer step brings the photosensitive drum into continuous contact with continuous paper conveyed at the same speed as a circumferential velocity of the photosensitive drum, and continuously forms a toner image corresponding to the electrostatic latent image on the continuous paper using a transfer unit. The fixing step fuses and fixes the toner image on the continuous paper by the application of heat or pressure, or light irradiation by a fixing unit, thereby obtaining a printed matter.

The paper feeder part includes a hopper accommodating folded continuous paper. The conveyor part conveys the continuous paper from the paper feeder part to the collecting part through the printing part. The conveyor part typically includes an automatic loading part, and a conveyor roller. At both sides of the continuous paper are provided, for example, round apertures (sprocket holes), and the conveyor part includes conveyor pins and a pin roller (or belt with teeth) that corresponds to the apertures and moves in synchronous with rotation of the photosensitive drum, to convey continuous paper at high speed by fitting pins into the apertures of the continuous paper. During conveyance of continuous paper, the continuous paper is subjected to the processes in the transfer and fixing steps, and precisely synchronized operations between the conveyance of the continuous paper and the rotation of the photosensitive drum make a high-quality transfer possible. The collecting part includes a stacker that stores continuous paper that has been printed. The stacker also serves to eject the continuous paper that has been printed out of the device. The continuous paper that has been ejected out of the device undergoes a variety of processes such as cutting in a post-processor electrically connected with the continuous paper printer.

However, a conventional continuous paper printer is disadvantageously susceptible to a jam and image degradation. To be more specific, in the conventional continuous paper printer, an irregular load that would be applied to continuous paper when the conveyor part draws out the continuous paper from the hopper would pull the continuous paper in a direction opposite to the drawing direction. Accordingly, a conveyance speed of the continuous paper would vary, and thus a poor transfer results, or a local application of the above load would cause the continuous paper to swerve from a conveyance route, and produce a jam. A description will now be given of loads applied to the continuous paper, with reference to FIGS. 7 through 9.

Continuous paper P is stored in a hopper 1 so that each folded side may come into contact with wall surfaces of the hopper 1 so as to prevent the continuous paper P from moving in the hopper 1, and affecting the conveyance. When the continuous paper P is drawn out from the hopper 1, if the uppermost fold of the continuous paper P were not in contact with the wall of the hopper 1 as shown in FIG. 7, the continuous paper P would be conveyed with no irregular load applied thereto.

Faster printing processes demanded in recent years require increased speed at conveying the continuous paper P. Fast conveyance would generate vibrations in the continuous paper P, and often cause the continuous paper P to be drawn out with the fold kept in contact with the wall surface of the hopper 1. If the continuous paper were conveyed with the fold kept in contact with the wall surface of the hopper 1, space formed with the wall surface of the hopper 1 and the continuous paper P would decompress as shown in FIG. 8, and thereafter, part of the continuous paper P would be adhered closely to the wall surface of the hopper 1 as shown in FIG. 9. This phenomenon would occur more frequently particularly when the amount of the continuous paper P stored in the hopper 1 becomes small. The closely adhered continuous paper P to the hopper 1 would cause an irregular load to be applied to the continuous paper P partially or entirely. Such a load would pull the continuous paper in a direction opposite to a drawing direction, and thus reduce the conveyance speed of the continuous paper that is being drawn out. Accordingly, the conveyance speed of the continuous paper P would vary. Consequently, a jam due to misaligned continuous paper P, or deteriorated image quality due to a poor transfer caused by loss of synchronism with the photosensitive drum would result. Hereupon, FIG. 8 is a schematic sectional view for illustrating decompressed space formed with the continuous paper P and the wall surface of the hopper 1. FIG. 9 is a schematic sectional view for showing the continuous paper P adhered closely to the hopper 1.

In order to prevent such adhesion of the continuous paper P to the hopper 1, holes that allow air to flow through the wall of the hopper 1 might possibly be formed to prevent the decompression. However, this would be impractical due to disadvantages such as a possible increase in costs of hoppers as accompanied by recent year's diversification of recordable media, and continuous printers' incapability of using a variety of hoppers.

As shown in FIG. 10, a roller pair might be provided directly above the continuous paper P stored in the hopper 1 to regulate a conveyance route of the continuous paper P. FIG. 10 is a schematic sectional view for showing a conventional swing prevention mechanism for continuous paper P. The roller pair includes an immovable roller unit 2 and a movable roller unit 3. The immovable roller unit 2 is anchored perpendicularly on a main body housing of the continuous paper printer, and includes at a distal end thereof a roller portion 2*a*, which may rotate while keeping in contact with the continuous paper P. The movable roller unit 3 is joined via a joint 4 to the housing of the continuous paper printer, and is manually pivotable about the joint 4 as indicated by a dotted line and a solid line. The movable roller unit 3 also includes at a distal end thereof a roller portion 3*a*, which may rotate while keeping in contact with the continuous paper P. During the conveyance, the roller portion 2*a* of the immovable roller unit 2 and the roller portion 3*a* of the movable roller unit 3 are located at the same height from the continuous paper P. When the continuous paper P is replenished, on the other hand, the movable roller unit 3 is manually moved away to a position indicated by the dotted line. After the continuous paper P is replenished, the movable roller unit 3 is manually moved to a position indicated by the solid line. This roller pair serves to regulate a conveyance route of the continuous paper P, and thus may prevent the continuous paper P from being adhered to the hopper 1. However, since a height of the roller portion 2*a* cannot be changed, the hopper 1 that accommodates, for example, more than three thousand sheets of continuous paper P cannot be used with this roller pair. Moreover, the manual operation of the movable roller unit 3 would possibly induce a human based error. Further, the units 2 and 3 are optionally applied to a continuous paper printer, and each unit is configured to be detachably attachable independently; therefore the device is not configured as a whole to be a movable mechanism that moves vertically. Accordingly, as printing proceeds, a distance between the roller portion 2*a* and a top of a folded stack of continuous paper P would increase, and thus the regulatory effect produced by the units 2 and 3 would decrease.

BRIEF SUMMARY OF THE INVENTION

Therefore, it is an exemplified general object of the present invention to provide a novel and useful guide mechanism, paper feed control method, and image-forming device in which the above conventional disadvantages are eliminated.

Another exemplified and more specific object of the present invention is to provide a guide mechanism, paper feed control method, and image-forming device that can prevent a jam and image degradation from occurring.

In order to achieve the above objects, a guide mechanism as one exemplified embodiment of the present invention comprises a guide part that guides continuous paper from a paper feeder part storing the continuous paper to a conveyor part, while regulating a conveyance route of the continuous paper; and a driving part that drives the guide part and the paper feeder part to relatively and automatically move according to a storage amount of the continuous paper in the paper feeder part. Since the driving part can move relatively and automatically within a distance between the guide part and the paper feed part according to this guide mechanism, for instance, the guide part may be moved away so as not to hinder a user's operation such as replenishing the continuous paper. Moreover, the driving part can automatically move the guide part and/or the paper feed part, and thus human based errors due to manual movement can be avoided.

A paper feed control method as another exemplified embodiment of the present invention comprises the steps of determining space between a guide part that regulates a conveyance route of continuous paper, and a stack of the continuous paper; controlling a driving part to keep the space between the guide part and a stack of the continuous paper at a given distance; and controlling the driving part under a specified condition to automatically set the space between the guide part and a stack of the continuous paper apart to a specified distance not less than the given distance. During conveyance of the continuous paper, a distance between a stack of the continuous paper and the guide part can be kept constant, and the regulatory effect of the guide part can be maintained irrespective of the remaining amount of the continuous paper. Automatically spacing not less than a specified distance between the guide part and a stack of the continuous paper under a specified condition would allow the guide part to be moved away. Such moving away operation would prevent the guide part from hindering a user's operation and facilitate the user's setting of the continuous paper.

An image-forming device as one exemplified embodiment of the present invention comprises: a paper feeder part that stores continuous paper; a conveyor part that conveys the continuous paper from the feeder part; a guide part that is provided between the paper feeder part and the conveyor part, and guides the continuous paper to the conveyor part, while regulating a conveyance route of the continuous paper; a driving part that drives the guide part and the paper feeder part to relatively move according to a storage amount of the continuous paper; and a printing part that forms an image on the continuous paper fed from the paper feeder part through the guide part. This image-forming device exhibits the same operation as the above guide mechanism.

Other objects and further features of the present invention will become readily apparent from the following description of the embodiments with reference to accompanying drawings.

DETAILED DESCRIPTION OF THE INVENTION

Figure 1:
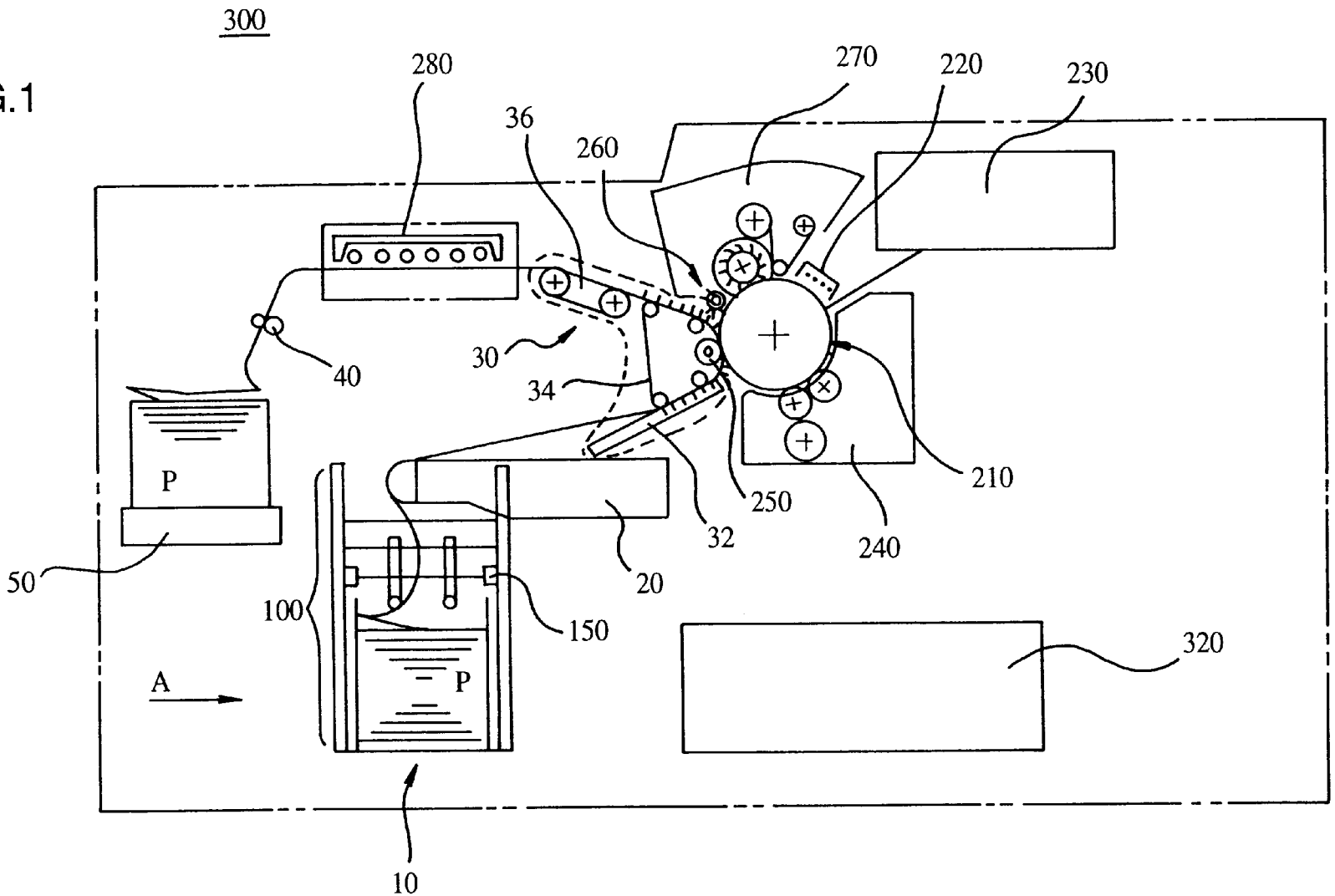
FIG. 1 is a schematic sectional view of an image-forming device as one exemplified embodiment of the present invention.

Referring now to FIG. 1, a description will be given of an image-forming device 300 as one exemplified embodiment of the present invention, which is embodied herein as a continuous paper printer. In each figure, those elements designated by the same reference numerals denote the same elements, and a duplicate description thereof will be omitted. Hereupon, FIG. 1 is a schematic sectional view of the image-forming device 300. In the present embodiment, the image-forming device 300 is a single-sided type that forms an image on a single side of continuous paper P, but a double-sided type including a pair of image-forming parts may be employed.

In the present embodiment, as an example of the continuous paper P is used fanfold paper. At both edges of the fanfold paper are formed sprocket holes, and a conveyor part 30 conveys the continuous paper P with the sprocket holes engaged with tractor feed pins in an automatic loading part 32 that will be described later. The width of the continuous paper P to be used is selected, as necessary, among those of ready-made paper that have a standardized or predetermined width. There are two types of the continuous paper P: one in which perforations are formed, and the separation is carried out by pressurizing the perforations; and the other in which the separation is carried out by a cutter equipped in a post-processor.

The continuous paper printer 300 includes a hopper 10, a guide mechanism 100, a guide table 20, a conveyor part 30, a scuff roller 40, a stacker 50, and a printing part 200. The printing part 200 includes a photosensitive drum 210, a pre-charger 220, an exposure device 230, a development device 240, a transfer part 250, a charge elimination part 260, a cleaning part 270, and a fixer 280. The continuous paper printer 300 further includes a housing-in-part 310, a main power supply 320, and a controller 330. The main power supply 320 is provided in the continuous paper printer 300 as shown in FIG. 1, and a user may directly turn the power supply 320 on or off. Otherwise, the controller 330 may control the power supply 320 so that the power supply 320 may be automatically turned on or off when a predetermined time has come. It goes without saying that the guide mechanism 100 of the present embodiment may be applied to both the image-forming devices for single-sided and double-sided printings.

Figure 11:
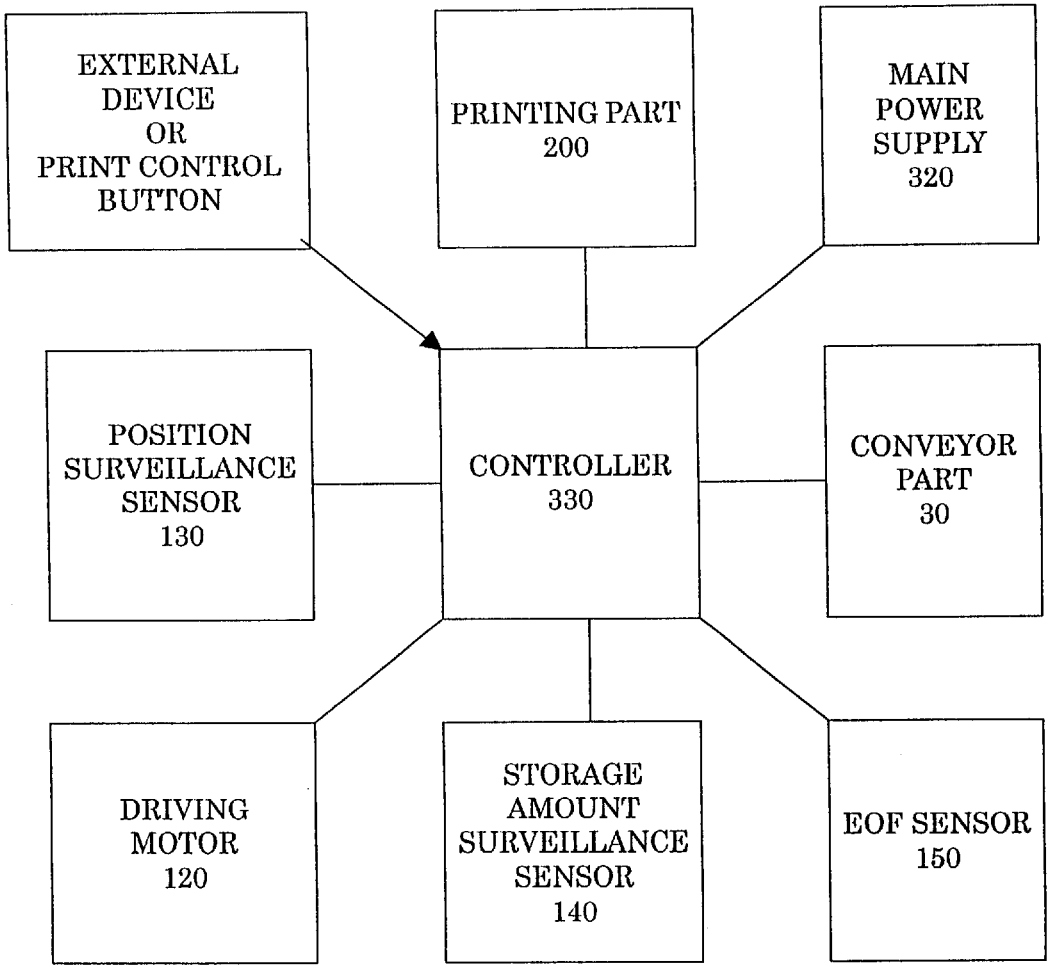
FIG. 11 is a block diagram for explaining a controller.

The controller 330 controls, as shown in FIG. 11, a conveyor part 30, a driving motor 120, a position surveillance sensor 130, a storage amount surveillance sensor 140, a printing part 200, and a power supply 320. FIG. 11 is a block diagram for explaining the controller 330. The controller 330 is provided in the continuous paper printer 300, and controls all the operations of the continuous paper printer 300 including the procedural steps of paper feeding, conveying, printing, collecting, and others. In addition, the controller 330 receives a print (start) command or print (stop) command generated from an external device, such as a PC, or a print control button on the continuous paper printer that a user directly presses, and controls printing operations.

The hopper 10 is a storage part that stores the continuous paper P folded in a stack. The hopper 10 assumes a variety of shapes according to the size of the continuous paper P, capacity, and the like, and one or more of the hopper 10 may be provided in the continuous paper printer 300 for alternate use.

Figure 2:
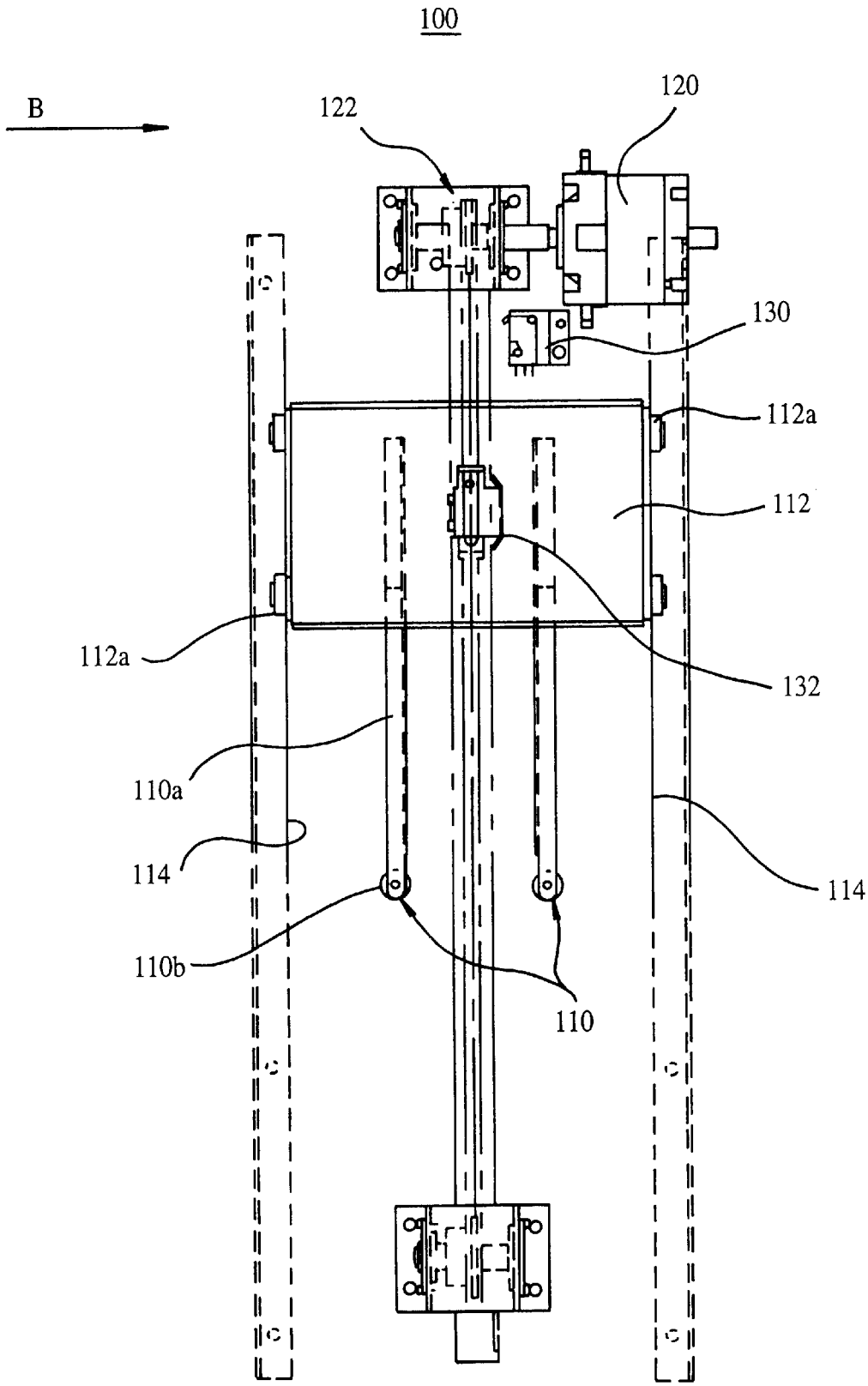
FIG. 2 is a magnified sectional view of a guide mechanism as viewed from a direction A in FIG. 1.
Figure 3:
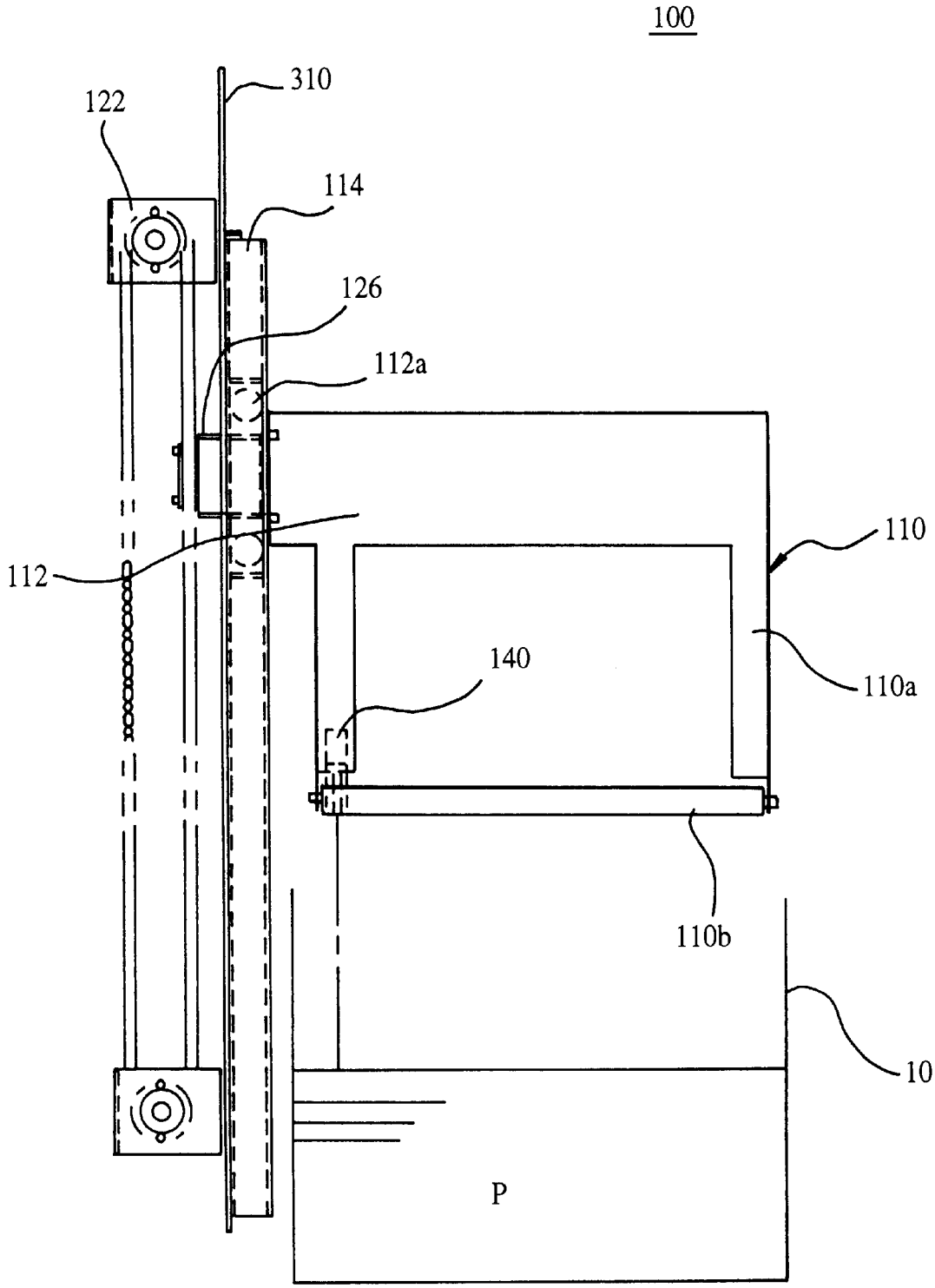
FIG. 3 is a sectional view of the guide mechanism as viewed from a direction B in FIG. 2.
Figure 4:
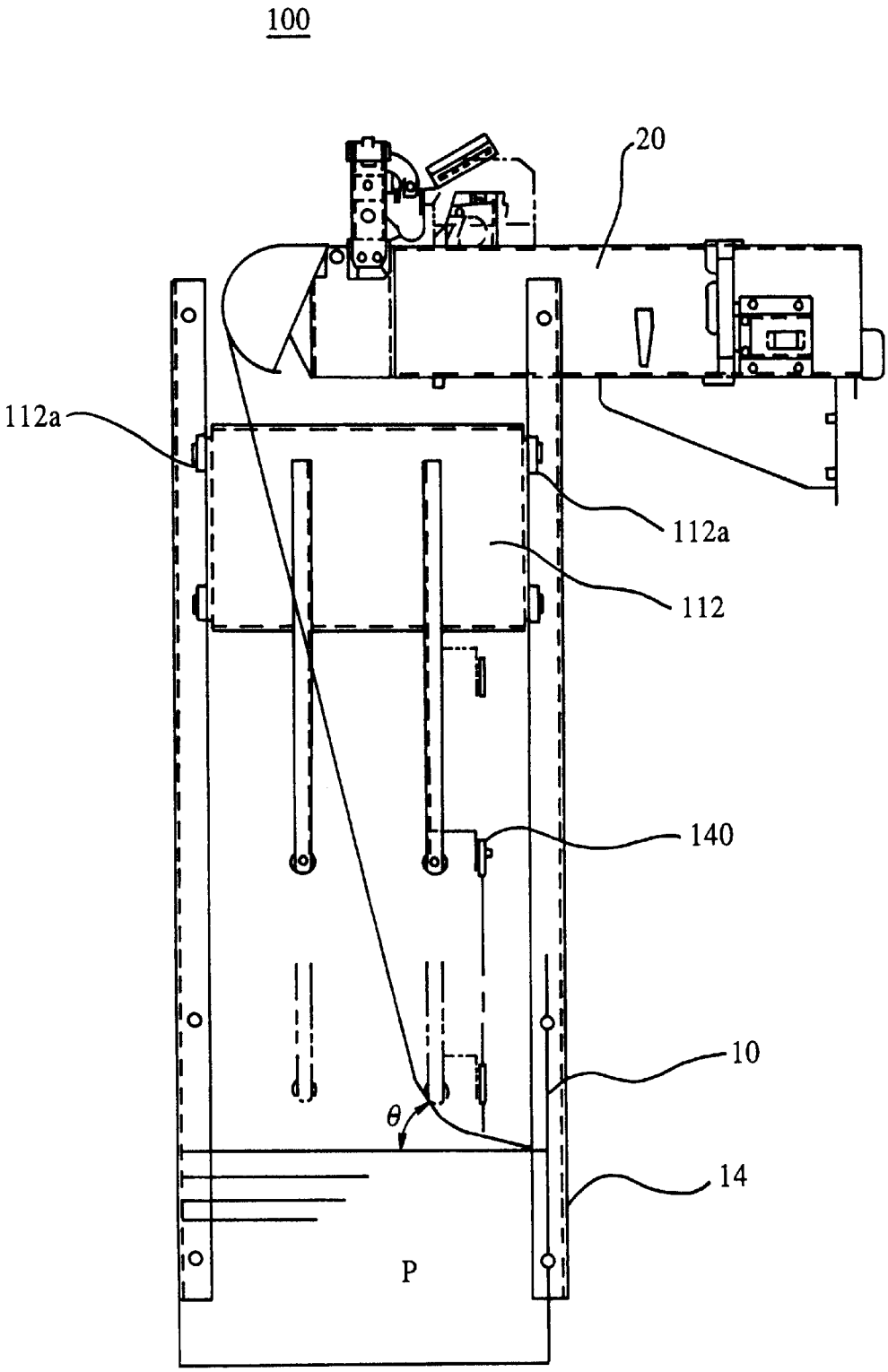
FIG. 4 is a sectional view for explaining an operation of a storage amount surveillance sensor.
Figure 9:
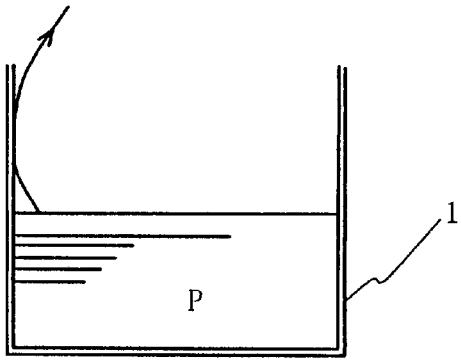
FIG. 9 is a schematic sectional view for showing continuous paper P adhered closely to a hopper.
Figure 10:
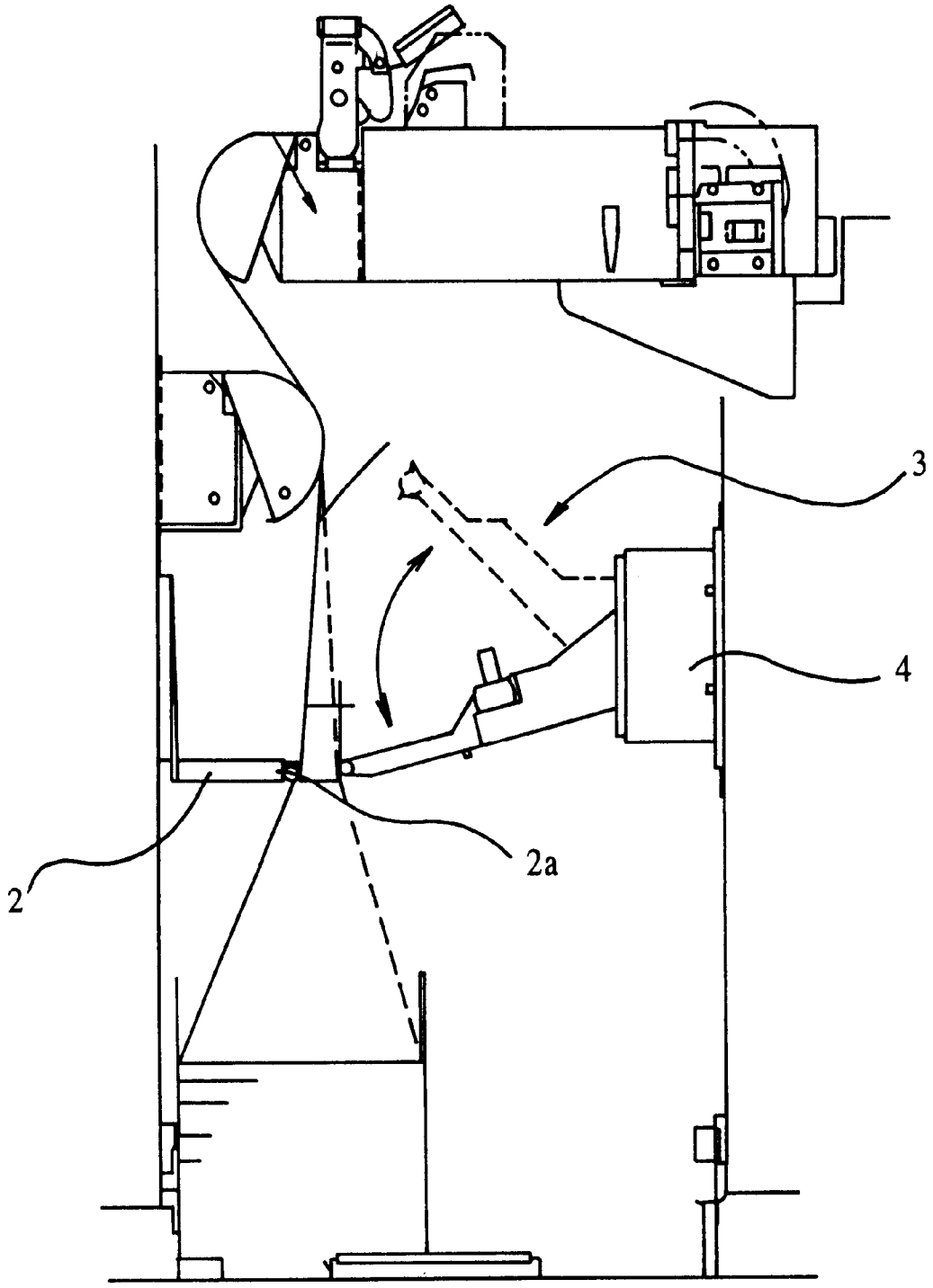
FIG. 10 is a schematic sectional view for showing a conventional swing prevention mechanism for continuous paper

The guide mechanism 100 regulates a conveyance route of the continuous paper P when the continuous paper P stored in the hopper 10 is fed, and serves to prevent the continuous paper P from being conveyed while the fold of the continuous paper P is kept in contact with the wall surface of the hopper 10 as shown in FIG. 9, forming a decompressed space. Resultantly, the guide mechanism 100 serves to accomplish excellent conveyance of the continuous paper. The guide mechanism 100 also serves to detect the end of the continuous paper P. Referring now to FIGS. 2 through 4, a description will be given of the guide mechanism 100. FIG. 2 is a magnified sectional view of the guide mechanism 100 as viewed from a direction A in FIG. 1. FIG. 3 is a sectional view of the guide mechanism 100 as viewed from a direction B in FIG. 2. FIG. 4 is a sectional view for explaining the storage amount surveillance sensor 140 of the guide mechanism 100.

As shown in FIGS. 1 through 4, the guide mechanism 100 includes a guide roller pair 110, a driving motor 120, a position surveillance sensor 130, a storage amount surveillance sensor 140, and an EOF sensor 150. As shown in FIGS. 3 and 4, the guide roller pair 110 is located directly above the hopper 10 storing the continuous paper P. The continuous paper P is regulated to pass through a proper conveyance route by passing between the guide roller pair 110 as shown in FIG. 4, and is thereby prevented from being conveyed while keeping the fold in contact with the wall surface of the hopper 10.

To be more specific, the guide roller pair 110 is comprised of an arm portion 110*a* and a roller portion 110*b* supported at a distal end of the arm portion 110*a*. The arm portion 110*a* is brought into contact at a midsection thereof with the continuous paper P, and regulates the conveyance route. Accordingly, the longer the arm portion 110*a* is extended, the more the regulatory effect increases, thereby making good conveyance of the continuous paper P possible. Since the regulatory effect varies with the size and stiffness of the continuous paper P, an optimum value of the length of the arm portion 110*a* can be arithmetically or experimentally worked out in accordance with the kinds of the continuous paper P. In the guide mechanism 100 of the present invention, a distance between the guide roller pair 110 and a length of the arm portion 110*a* may be adjusted to the kinds of the continuous paper printer 300, the hopper 10, and the continuous paper P. In the present embodiment, the distance of the guide roller pair 110 is 30 mm, and the length of the guide roller 110*a* and 110*b* is 160 mm.

As shown in FIG. 3, the arm portion 110*a* is secured on a roller pair support metal member 112, and a pair of arm portions 110*a* supports the both ends of one roller portion 110*b*. The arm portion 110*a* may be secured on the roller pair support metal member 112, for example, by screws, or bond. In the present embodiment, screws are adopted. The adoption of screws provides advantages such as easy replacement with another guide roller pair different in length. In addition, the roller portion 110*b* is allowed to rotate by contact with the continuous paper P, and thus regulation of the conveyance route of the continuous paper P would not cause friction or the like to impose loads on the continuous paper P. The right roller portion 110*a* is used when the continuous paper P is folded at the right side as shown in FIG. 4, while the left roller portion 110*a* is used when the continuous paper P is folded at the left side as shown in FIG. 1.

In order to prevent the continuous paper P from being conveyed while keeping the fold in contact with the wall surface of the hopper 10, the problem lies in an initial drawing angle. If a drawing angle θ as shown in FIG. 4 is great, that is, if the guide roller pair 110 is spaced from continuous paper P, then the continuous paper P is more likely to be drawn upward, and thus to be conveyed while keeping the fold in contact with the wall surface of the hopper 10. On the other hand, if the drawing angle θ is little enough, that is, if the guide roller pair 110 is in close vicinity to the continuous paper P, then the continuous paper P is more likely to be drawn laterally, and thus less likely to be conveyed while keeping the fold in contact with the wall surface of the hopper 10. A distance between the roller portion 110*b* and the topmost sheet of the continuous paper P may be determined in consideration of the size and stiffness of the continuous paper P.

The roller pair support metal member 112 is a boxy element on which the above-described arm portion 110*a* is secured, and connected with a guide rail 114 via the roller 112*a*. The roller 112*a* is rotatably provided on the guide rail 114, and the roller pair support metal member 112 may move along the guide rail 114 as the roller 112*a* rotates.

The guide rail 114 is a pillar-shaped element connected directly or indirectly with the hopper 10, and provided parallel to a direction in which the continuous paper P is stacked, and used as a support for the guide mechanism 100. The guide rail 114 runs the length from the hopper 10 to a guide table, as shown in FIG. 4, and serves to get the guide roller pair 110 out of an operation area where a user may replenish continuous paper P in the hopper 10. The guide rail 114 is secured on the housing-in-part 310 in the continuous paper printer 300 as shown in FIG. 3. As described above, the movement of the roller pair support metal member 112 on the guide rail 114 makes the guide roller pair 110 secured on the roller pair support metal member 112 move vertically.

The driving motor 120 is a driving source for moving the guide roller pair 110. The driving motor 120 is operated under the control of the controller 330. More specifically, the controller 330 assesses information detected from outputs of the position surveillance sensor 130 and the storage amount surveillance sensor 140, and thereby controls operations of the driving motor 120. The driving motor 120 is connected with a gear 122, and makes the same rotate. As the gear 122 rotates, an endless chain 124 shown in FIG. 3 moves. The chain 124 is connected with a metal anchor 126, and when the chain starts moving in synchronization with the rotation of the driving motor 120 and the gear 122, the metal anchor 126 synchronously starts moving too. The metal anchor 126 is also connected with the roller pair support metal member 112, and thus the guide roller pair 110 moves in synchronization with the movement of the metal anchor 126.

The position surveillance sensor 130 monitors a position (or height) of the guide roller pair 110. The position surveillance sensor 130 is provided for the purpose of getting the guide roller pair 110 upward out of a user's operation area where continuous paper P may be replenished or added. The position surveillance sensor 130 is switched between the states of outputting and of not outputting under the control of the controller 330. For the position surveillance sensor 130 is used, for example, a microswitch, which is paired with a detection metal member 132 for sensor detection. The detection metal member 132 is provided so as to connect with the roller pair support metal member 112. Before the continuous paper P is automatically loaded, that is, until the continuous paper P is made ready for use, the detection metal member 132 has been moved to a position in which the microswitch may perform detection. Accordingly, the guide roller pair 110 connected with the roller pair support metal member 112 moves upward too. The guide roller pair 110 moves upward enough beyond the hopper 10. Therefore, the presence of the guide roller pair 110 would have little effect on a user's operation of replenishing or adding continuous paper P.

The storage amount surveillance sensor 140 monitors a distance between a topmost sheet of continuous paper P and the guide roller pair 110. The storage amount surveillance sensor 140 is, like the position surveillance sensor 130, switched between the states of outputting and of not outputting under the control of the controller 330. As shown in FIG. 4, the storage amount surveillance sensor 140 is provided outside the roller portion 110*b* held at an end of the guide roller pair 110, and at the same height as the roller portion 110*b*, so as not to interfere with the regulatory function for the continuous paper P. Thus, the storage amount surveillance sensor 140 may detect a position of the top of stacked continuous paper P that has not yet been drawn upward. For the storage amount surveillance sensor 140 is used, for example, a reflection type photosensor, which detects a reflective signal reflected from a surface of the continuous paper P. To be specific, while the storage amount surveillance sensor 140 is detecting the reflective signal from the continuous paper P, a distance between the continuous paper P and the guide roller pair 110 is kept at a fixed length. Even if continuous paper P is fed, and a storage amount thereof varies, a regulatory effect of the guide roller pair 110 on the continuous paper is kept constant. With consideration given to a load applied to the continuous paper by the guide roller, a drawing angle θ, and a permissible distance for the sensor 140 to detect a reflective signal, the distance between the continuous paper P and the guide roller pair 110 is preferably to be set between 10 and 15 mm. This range of values never varies with the sizes and types of the continuous paper.

The EOF (End of Form) sensor 150 detects the end of continuous paper P. The EOF sensor 150 is switched between the states of outputting and of not outputting under the control of the controller 330. For the EOF sensor 150 is employed, for example, a transmission type optical sensor. As shown in FIG. 1, when a light is irradiated across an upper portion of the continuous paper P from a light-emitting element to a light-receiving element, the continuous paper P, if normally conveyed, interrupts the light. However, when the end of the continuous paper P has passed through the irradiation spot, the light passes without interruption. Recognizing this change reveals the presence or absence of the continuous paper P, and thus enables the end portion to be detected.

The guide mechanism 100 according to the present invention serves to raise the guide roller pair 110 when the continuous paper P is replenished, using the position surveillance sensor 130. Therefore, a user's operation of replenishing the continuous paper P is not hindered. In addition, the guide mechanism 100 of the present invention includes the storage amount surveillance sensor 140 that can keep a specific distance between the guide roller pair 110 and the topmost sheet of the continuous paper P. Therefore, the guiding capability would not vary with conveyance conditions of the continuous paper P, and thus prevent the continuous paper P drawn upward from being conveyed while keeping the fold in contact with the wall surface of the hopper 10, providing a good conveyance condition of the continuous paper P. Accordingly, a degraded printing quality or a jam due to disordered conveyance of the continuous paper P would be prevented.

Although the above-described embodiment of the guide mechanism 100 regulates the continuous paper P by changing a position (height) of the guide roller pair 110, another embodiment that changes a position of the hopper 10 that stores continuous paper P may exhibit the same effect. To be more specific, the guide mechanism 100 may include the hopper 10 configured to move vertically along the guide rail 114 by a driving force of the driving motor 120.

The guide table 20 is a member to smooth out the folds of the continuous paper P or to remove twists or warps thereof so as to convey the continuous paper P to the printing part 200 in an excellent state.

The conveyor part 30 conveys the continuous paper P until a printing image is fixed on the continuous paper P. The conveyor part 30 includes an automatic loading table 32, a transfer belt 34, and a conveyor roller 36. The automatic loading table 32 is provided with a conveyor motor 32*a* (not shown), and exhibits a feeding capability for conveying the continuous paper P. The continuous paper P as used in the present embodiment is formed with sprocket holes at both edges thereof, and conveyed to the transfer belt 34 with the sprocket holes engaged with conveying tractor pins of the automatic loading table 32. An operation of fitting the continuous paper P into the automatic loading table 32 is referred to as "automatic loading". Usually, the automatic loading is manually initiated by a user who fits the sprocket holes of the continuous paper P into the pins of the automatic loading table 32. Thereafter, the controller 330 mainly controls the conveyor motor 32*a*, operates the conveyor part 30, and leads the front end of the continuous paper P to a specified position where printing is carried out.

The transfer belt 34 is an endless belt that conveys the continuous paper P using the above-described conveying tractor pins or electrostatic adsorption. Synchronized conveying speed of the transfer belt 34 with the photosensitive drum 210 would permit an excellent image transfer onto the continuous paper P. The transfer roller 36 conveys the continuous paper P on which images have been transferred to an image fixing position. In order to keep the conveyance of the continuous paper P excellent, the conveyance speed is preferably adjusted to the same as that of the transfer belt 34.

A scuff roller 40 leads the continuous paper P that has finished a complete printing process in the fixer 280 to the stacker 50. The continuous paper P is folded as before the printing process and stored in the stacker 50.

The photosensitive drum 210 includes a photosensitive dielectric layer on a rotatable drum-shaped conductor support, and is used for an image holding member. The photosensitive drum 210, which is, for instance, made by applying a function separation-type organic photoreceptor with a thickness of about 20 $\mu$m on a drum made of aluminum, has an outer diameter of 30 mm, and rotates at a circumferential velocity of 70 mm/s in a predetermined direction. The pre-charger 220 is comprised, for instance, of a scorotron-electrifying device, and gives a constant amount of electric charges (e.g., about −700 V) on a surface of the photosensitive drum 210.

The exposure device 230 includes, for instance, an LED array arranged as an optical writing unit. When the light is irradiated and scans by the LED array on the photosensitive drum 210, the uniform charge at the irradiated area on the photosensitive drum 210 corresponding to the image is eliminated through exposure to light, and a latent image is formed. To be more specific, light-emitting devices arranged in a main scanning direction of the LED array is driven according to the levels of tone of imaging data (dot data) converted from image data provided as printing information from a host device such as a computer, and a word-processor. Consequently, the electrostatic latent image is written as a dot image.

The development device 240 serves to visualize a latent image formed on the photosensitive drum 210 into a toner image. The development device 240 includes a development roller, a reset roller, and a toner cartridge. The developing agent may include one or two components (i.e., it may include a carrier) without distinction as to whether it is magnetic or nonmagnetic. The toner cartridge stores toner and supplies toner to the reset roller. The reset roller comes into contact with the development roller, and supplies toner to the development roller. The reset roller is placed in or out of contact with the photosensitive drum 210, and supplies toner to the photosensitive drum 210 by electrostatic force. Consequently, a toner image is formed on the photosensitive drum 210. Unused toner remaining on the development roller is collected by the reset roller and brought back into the toner cartridge.

The transfer part 250, which includes, for instance, a transfer roller, generates an electronic field to electrostatically adsorb toner, and transfers the toner image adsorbed on the photosensitive drum 210 onto continuous paper P utilizing a transfer current. The transfer part 250 is, as shown in FIG. 1, opposed to the photosensitive drum 210 through the continuous paper P.

The charge elimination part 260 eliminates electric charges on the photosensitive drum 210 from which the toner has been transferred out. If the charge elimination part 260 eliminates electric charges on the photosensitive drum 210, the adsorptive force of residual toner onto the photosensitive drum 210 lowers. Consequently, the cleaning part 270 that will be described below is facilitated to separate the residual toner from the photosensitive drum 210.

The cleaning part 270 collects and disposes of toner remaining on the photosensitive drum 210 after the transfer process, or as necessary returns the toner collected by a screw conveyor or like collection device to the toner cartridge. The cleaning part 270 also serves to collect debris on the photosensitive drum 210. The cleaning part 270 may utilize varied kinds of means including magnetic force and rubber friction to remove the toner and charges on the photosensitive drum 210.

The fixer 280 serves to permanently fix toner onto continuous paper P. The transferred toner is adhered onto continuous paper P only with an electrostatic force, and thus easily fallen off. Therefore, the toner is fixed using energy such as pressure and heat, but in order to obtain sufficient fixing capability, the solid-state toner needs become liquefied. Application of the energy may propel the solid toner to be sintered, spread, and permeated, so that the fixing process is completed.

Figure 5:
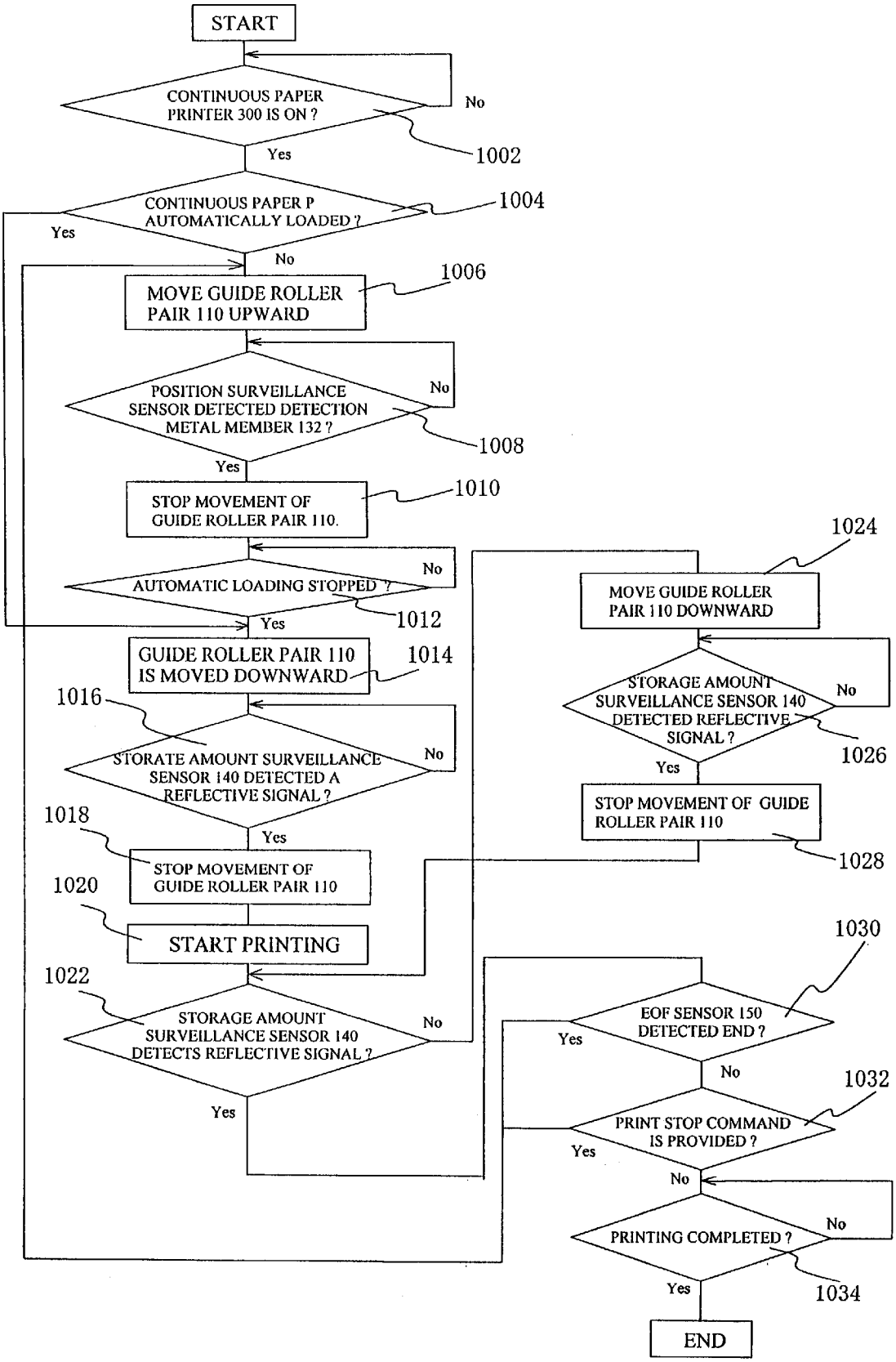
FIG. 5 is a flowchart showing a paper feed control method.
Figure 6:
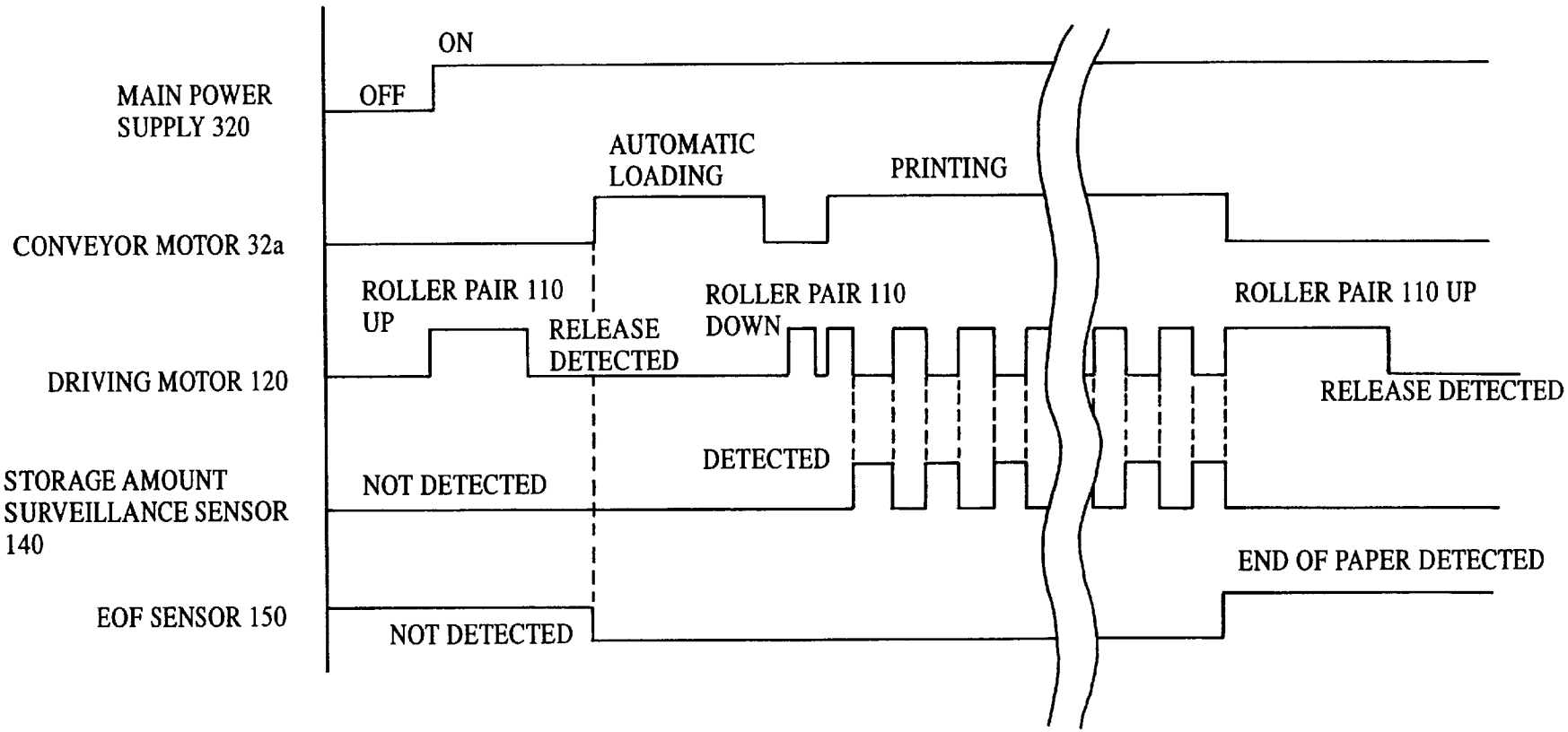
FIG. 6 is a timing chart showing an operation of a motor and a sensor according to the paper feed control method shown in FIG. 5.
Figure 7:
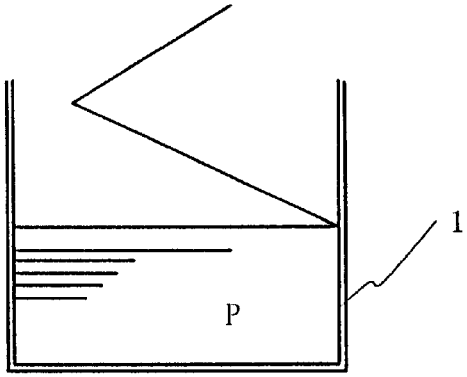
FIG. 7 is schematic sectional view of continuous paper conveyed from a hopper at low conveyance speed.
Figure 8:
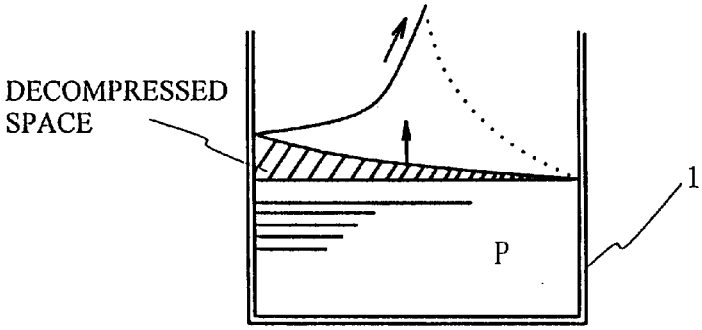
FIG. 8 is a schematic sectional view for showing decompressed space formed with continuous paper and a wall surface of a hopper.

Referring now to FIGS. 1, and 4 through 6, a description will be given of an operation of the continuous paper printer 300. FIG. 5 is a flowchart showing a paper feed control method. FIG. 6 is a timing chart showing an operation of a motor and a sensor according to the paper feed control method shown in FIG. 5.

As shown in FIG. 5, the controller 330 first determines that the main power supply 320 of the continuous paper printer 300 is on (step 1002), and then detects whether the continuous paper P is automatically loaded (step 1004). If the continuous paper P is not automatically loaded, the controller 330 actuates the driving motor 120, to move the guide roller pair 110 upward (step 1006). As shown in FIG. 6, when the main power supply 330 is turned on, the driving motor 120 starts operating, and the guide roller pair 110 moves upward so as not to hinder a user from replenishing continuous paper P and from manually initiating automatic loading. Next, the controller 330 determines that the position surveillance sensor 130 has detected the detection metal member 132 corresponding thereto (step 1008), and then stops the driving motor 120 and stops the movement of the guide roller pair 110 as shown in FIG. 6 (step 1010). If the controller 330 determines that the position surveillance sensor 130 has not detected the corresponding detection metal member 132 (step 1008), the guide roller pair 110 is further moved upward (step 1006). At that moment, the user is allowed to replenish or add the continuous paper P, as necessary. Moreover, the user may manually initiate automatic loading. As shown in FIG. 6, during the steps 1002 through 1010, the EOF sensor is in the state of outputting and keeps the state of detecting the end of the continuous paper P, while the storage amount surveillance sensor 140 is in the state of not outputting and being suspended.

If the controller 330 detects that the continuous paper P is automatically loaded in step 1004, or that the automatic loading has been stopped after the step 1010 (step 1012), the controller 330 actuates the driving motor 120, and the guide roller pair 110 that has been moved upward is moved downward (step 1014). As shown in FIG. 6, after the automatic loading is stopped, the controller 330 drives the conveyor motor 32*a*, and conveys the continuous paper P to a predetermined area until the front end thereof reaches a specified position where printing can be carried out. When the front end has been conveyed to the specified position, and the conveyor motor 32*a* stops operating, the controller 330 actuates the driving motor 120, and moves the storage amount surveillance sensor 140 downward in order to check the storage amount of the continuous paper P before printing operation. Thereafter, the controller 330 determines that the storage amount surveillance sensor 140 has detected a reflective signal from the continuous paper P (step 1016), and then stops the driving motor 120, and stops the movement of the guide roller pair 110 as shown in FIG. 6 (step 1018). If the controller 330 determines that the storage surveillance sensor 140 has not detected the reflective signal (step 1016), the guide roller pair 110 is further moved downward (step 1014). In this manner, the storage amount surveillance sensor 140 detects the topmost sheet of the continuous paper P, and serves to adjust the distance between the topmost portion and the guide roller pair 110 within a specified range. Thereafter, the controller 330 provides a command to start a printing operation (step 1020). After the automatic loading is initiated until the printing operation is complete, the EOF sensor 150 keeps in the state of not outputting.

A description will be given of a printing operation of the continuous paper printer 300 with reference to FIG. 1. First, the photosensitive drum 210 is uniformly negatively charged (e.g., at −700 V) by the pre-charger 220. When a light is irradiated on the photosensitive drum 210 from the exposure device 230, the uniform charge at the irradiated area on the photosensitive drum 210 corresponding to an original image is eliminated through the exposure to light, and a latent image is formed. The development device 240 then develops the latent image. To be specific, the toner as a charged particle (or powder) bearing the electric charge of approximately −50 V is attracted using static electricity onto the area where the uniform charge is eliminated on the photosensitive drum 210. As a result, the latent image on the photosensitive drum 210 is visualized into a toner image.

Subsequently, the toner image on the photosensitive drum 210 is transferred on the continuous paper P. Then, the continuous paper P is in good conveyance condition through the use of the above-described guide mechanism 100, and thus a high-quality toner image may be formed. The toner remaining on the photosensitive drum 210 is collected by the charge elimination part 260 and the cleaning part 270. Thereafter, the toner image on the continuous paper P is permanently fixed in the fixer 280.

During continuous printing operation, the continuous paper P is being conveyed, and the storage amount thereof decreases. Accordingly, as shown in FIG. 6, the conveyor motor 320*a* keeps operating during the printing operation. The controller 330 determines whether the storage amount surveillance sensor 140 has detected a reflective signal from the continuous paper P (step 1022). The controller 330, if determining that no reflective signal has been detected in step 1022, lowers the guide roller pair 110 (step 1024), detects a reflective signal using the storage amount surveillance sensor 140 (step 1026), and stops lowering the guide roller pair 110 (step 1028), as in steps 1014 through 1018). As shown in FIG. 6, the controller 330 initiates a driving operation of the driving motor 120, and after keeping the operation for a specified period, stops the driving operation of the driving motor 120. Simultaneously with stopping the operation, the controller 330 switches the storage amount surveillance sensor 140 in the state of outputting to allow the sensor to detect a reflective signal. During printing operation, the above series of operations are repeated. In short, during a period when the continuous paper P is being conveyed continuously, the steps 1014 through 1018 are repeated, and thereby a distance between the topmost sheet of the continuous paper P and the guide roller pair 110 can be kept constant.

Referring now to FIG. 4, a further detailed description will be given of an operation of the storage surveillance sensor 140. When the continuous paper P is replenished, the guide roller pair 110 has been moved upward using the position surveillance sensor 130 so as not to hinder a user's operation. When the continuous paper P has been replenished, and conveyed to the automatic loading table 32 (in the state of automatic loading), the guide roller pair 110 lowers to a position where the storage amount surveillance sensor 140 may detect the continuous paper P. If a reflective signal detecting position (ranges of distance that permits detection) of the storage amount surveillance sensor 140 is preset, a distance between the guide roller pair 110 and the topmost sheet of the continuous paper P is kept constant. Therefore, as printing proceeds, and the storage amount of the continuous paper P in the hopper 10 decreases, the guide roller pair 110 also lowers with the decreasing amount. Accordingly, the guide roller pair 110 may regulate a conveyance route of the continuous paper P stably, regardless of the remaining amount of the continuous paper P even while the printing operation continues. Consequently, a distance between the guide roller pair 110 and the topmost sheet of the continuous paper P is kept constant, and thus the continuous paper P that is low in remaining amount may be prevented from being conveyed while the fold is kept in contact with the wall surface of the hopper 10.

If the controller 330 determines that a reflective signal has been detected in step 1022, the controller 330 determines whether the EOF sensor 150 has detected the end of the continuous paper P (step 1030). The controller 330 also determines whether a print stop command is provided (step 1032). If the controller 330 determines that the EOF sensor 150 has detected the end, or that the print stop command is provided, the controller 330 raises the guide roller pair 110 using the driving motor 120 (step 1006). If the controller 330 determines that the EOF sensor 150 has not detected the end, or that no print stop command is provided, the controller 330 determines whether printing is complete (step 1034), and stops printing operation. When the printing operation stops, the conveyance motor 32 and the detection of the storage amount surveillance sensor 140 stops operating. Further, the driving motor 120 moves the guide roller pair 110 until the position surveillance sensor 130 detects the same, and then the driving motor 120 stops operating. The EOF sensor 150 is switched into the state of detecting the end of the output continuous paper P, and keeps operating the detection. As described above, a series of printing operations is completed.

During and after continuous printing operation, the continuous paper P that has undergone fixing process is stored in the stacker 50 inside the continuous paper printer 300, or ejected out of the continuous paper printer 300, and undergoes post-processes such as cutting in a post-processor (not shown).

Although the preferred embodiments of the present invention have been described above, the continuous paper to which the present invention is applicable is not limited to the fanfold paper. For example, attaching the instant mechanism to an image-forming device employing paper in rolls could advantageously provide the same regulatory effect. Moreover, various modifications and changes may be made in the present invention without departing from the spirit and scope thereof.

As described above, according to the inventive guide mechanism, paper feed control method, and image-forming device, the guide roller pair may be raised utilizing the position surveillance sensor when continuous paper is replenished. Therefore, no hindrance is placed on user's operation when the continuous paper is replenished, and thus human errors would be avoided. In addition, an improvement in workability of replenishing the continuous paper would result.

Further, according to the inventive guide mechanism, paper feed control method, and image-forming device, a distance between the guide roller pair and the topmost sheet of the continuous paper could be kept constant utilizing the storage amount surveillance sensor. Accordingly, the continuous paper that is drawn upward could be prevented from being conveyed while keeping the fold in contact with the wall surface of the hopper, and from being adhered to the hopper. Consequently, the conveyance of the continuous paper would be made excellent, and a jam or image degradation would be prevented from occurring.

What is claimed is:

1. A guide mechanism comprising:

a guide part that guides continuous paper from a paper feeder part storing the continuous paper to a conveyor part, while regulating a conveyance route of the continuous paper; and a driving part that drives the guide part and the paper feeder part to relatively and automatically move according to a storage amount of the continuous paper in the paper feeder part.

2. A guide mechanism according to claim 1, wherein the guide part includes an arm portion that moves in a stacking direction of the continuous paper, and a roller portion that is supported at a distal end of the arm portion.

3. A paper feed control method comprising the steps of:

determining a space between a guide part that regulates a conveyance route of continuous paper, and a stack of the continuous paper;

controlling a driving part to keep the space between the guide part and a stack of the continuous paper at a given distance;

controlling the driving part under a specified condition to automatically set the space between the guide part and a stack of the continuous paper apart to a specified distance not less than the given distance; and determining whether a power has been turned on, wherein the specified condition is to determine that the power has been turned on.

4. A paper feed control method comprising the steps of:

determining a space between a guide part that regulates a conveyance route of continuous paper, and a stack of the continuous paper;

controlling a driving part to keep the space between the guide part and a stack of the continuous paper at a given distance;

controlling the driving part under a specified condition to automatically set the space between the guide part and a stack of the continuous paper apart to a specified distance not less than the given distance; and determining whether paper has run out in a paper feeder part that stores the continuous paper, wherein the specified condition is to determine that the paper has run out.

5. A paper feed control method comprising the steps of:

determining a space between a guide part that regulates a conveyance route of continuous paper, and a stack of the continuous paper;

controlling a driving part to keep the space between the guide part and a stack of the continuous paper at a given distance;

controlling the driving part under a specified condition to automatically set the space between the guide part and a stack of the continuous paper apart to a specified distance not less than the given distance; and determining whether a command to stop printing operation for the continuous paper has been provided, wherein the specified condition is to determine that the command to stop printing operation.

6. An image-forming device comprising:

a paper feeder part that stores continuous paper;

a conveyor part that conveys the continuous paper from the paper feeder part;

a guide part that is provided between the paper feeder part and the conveyor part, and guides the continuous paper to the conveyor part, while regulating a conveyance route of the continuous paper;

a driving part that drives the guide part and the paper feeder part to relatively move according to a storage amount of the continuous paper; and a printing part that forms an image on the continuous paper fed from the paper feeder part through the guide part.

7. An image-forming device according to claim 6, further comprising a controller part, wherein the controller part drives the driving part to relatively set a space between the guide part and the paper feeder part when the paper feeder part is replenished with the continuous paper.

8. An image-forming device according to claim 7, further comprising a position surveillance sensor that detects a position of the guide part, wherein the controller part controls the driving part based on a detected result of the position surveillance sensor.

9. An image-forming device according to claim 6, further comprising a controller part and a sensor that detects a remaining amount of the continuous paper, wherein the controller part controls the driving part to set the space between the continuous paper and the guide part within a specified range.

* * * * *